US008181791B2

(12) United States Patent
Pflueger

(10) Patent No.: US 8,181,791 B2
(45) Date of Patent: May 22, 2012

(54) ROTOR ELEMENT AND A ROTOR FOR A SCREENING APPARATUS

(75) Inventor: Cameron Pflueger, Vancouver (CA)

(73) Assignee: Aikawa Fiber Technologies Trust (CA)

( * ) Notice: Subject to any disclaimer, the term of this patent is extended or adjusted under 35 U.S.C. 154(b) by 96 days.

(21) Appl. No.: 12/593,997

(22) PCT Filed: Mar. 28, 2008

(86) PCT No.: PCT/FI2008/050144

§ 371 (c)(1),
(2), (4) Date: Mar. 3, 2010

(87) PCT Pub. No.: WO2008/119880

PCT Pub. Date: Oct. 9, 2008

(65) Prior Publication Data

US 2010/0258483 A1 Oct. 14, 2010

(30) Foreign Application Priority Data

Mar. 30, 2007 (FI) ..... 20070257

(51) Int. Cl.
*B07B 1/04* (2006.01)

(52) U.S. Cl. ..... 209/273; 209/306; 209/373

(58) Field of Classification Search ..... 209/273, 209/306, 363

See application file for complete search history.

(56) References Cited

U.S. PATENT DOCUMENTS

| | | | | |
|---|---|---|---|---|
| 3,437,204 | A * | 4/1969 | Clarke-Pounder | 209/273 |
| 4,193,865 | A * | 3/1980 | Aario | 209/240 |
| 4,894,147 | A * | 1/1990 | Rajala | 209/273 |
| 5,000,842 | A * | 3/1991 | Ljokkoi | 209/273 |
| 5,147,543 | A * | 9/1992 | Frejborg | 210/413 |
| 5,192,438 | A * | 3/1993 | Frejborg | 210/413 |
| 5,224,603 | A * | 7/1993 | Hanana et al. | 209/270 |
| 5,547,083 | A * | 8/1996 | Alajaaski et al. | 209/273 |
| 6,942,104 | B2 * | 9/2005 | Gallagher et al. | 209/273 |
| 2009/0084711 | A1 * | 4/2009 | Harju et al. | 209/270 |
| 2010/0258483 | A1 * | 10/2010 | Pflueger | 209/363 |

FOREIGN PATENT DOCUMENTS

| | | |
|---|---|---|
| EP | 0 764 736 | 3/1997 |

OTHER PUBLICATIONS

International Search Report for PCT/FI2008/050144 mailed Jul. 15, 2008.

Written Opinion for PCT/FI2008/050144 mailed Jul. 15, 2008.

* cited by examiner

*Primary Examiner* — Terrell Matthews

(74) *Attorney, Agent, or Firm* — Tech Valley Patent, LLC; John Pietrangelo

(57) ABSTRACT

The present invention relates to a rotor element for use with a rotor and a rotor featuring said elements. The rotor is used in a screening apparatus of the pulp and paper industry. The rotor element (10) has two longitudinal edges, a first, so-called leading edge (12) and a second, so-called trailing edge (14); two opposite ends, a first end and a second end; and a surface (18) arranged between said first edge (12) and said second edge (14), said surface (18) being divided by means of a borderline (20) into a first, so called leading surface (22) having its origin at said first edge (12), and a second, so called trailing surface (24) having its origin at said second edge (14), where a distance (W1) between said borderline (20) and said first edge (12) is smaller at said first end of said rotor element (10) than at the second end of said rotor element (10).

35 Claims, 4 Drawing Sheets

Figure 1A:
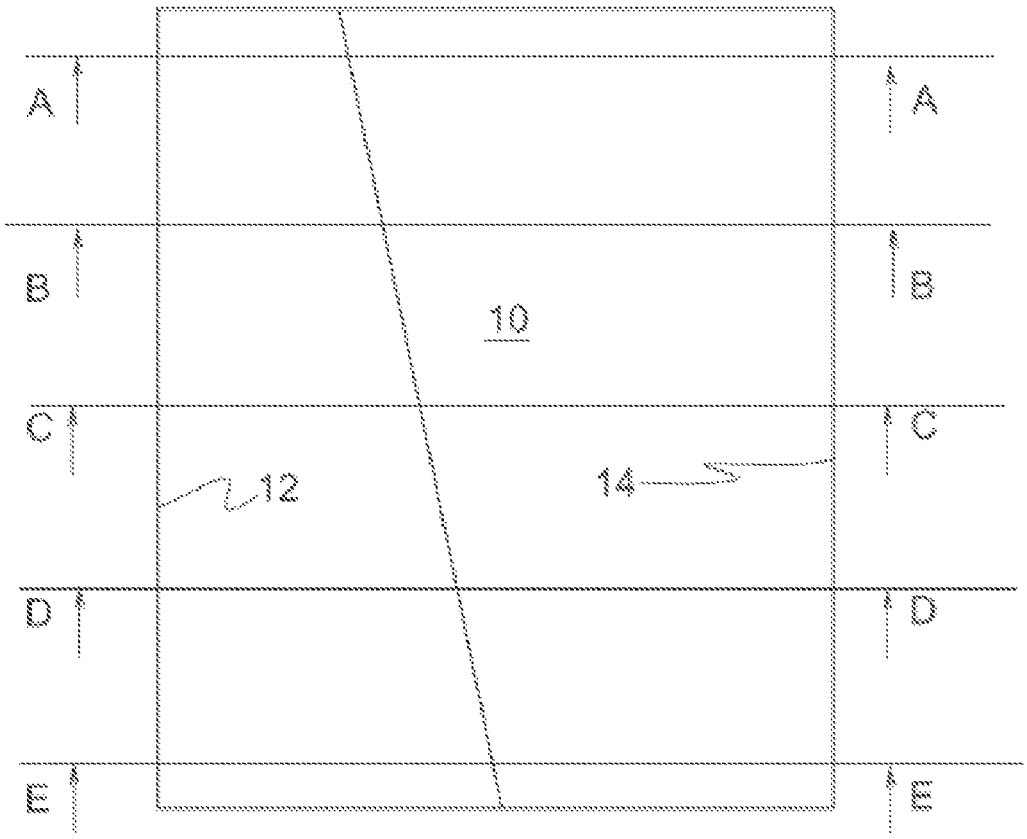

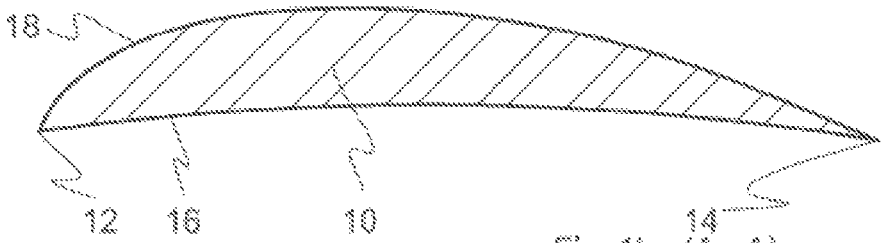
Fig. 1b (A - A)
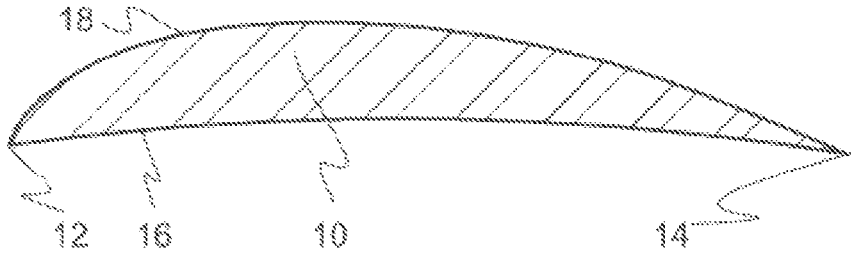
Fig. 1c (B - B)
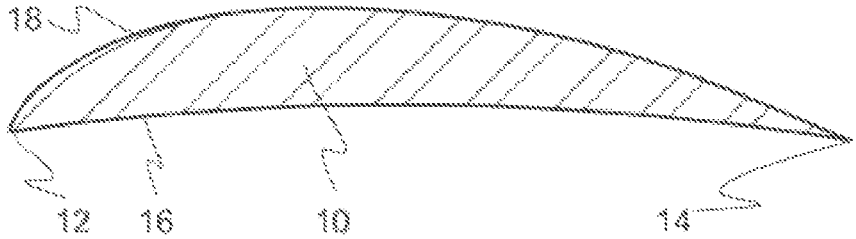
Fig. 1d (C - C)
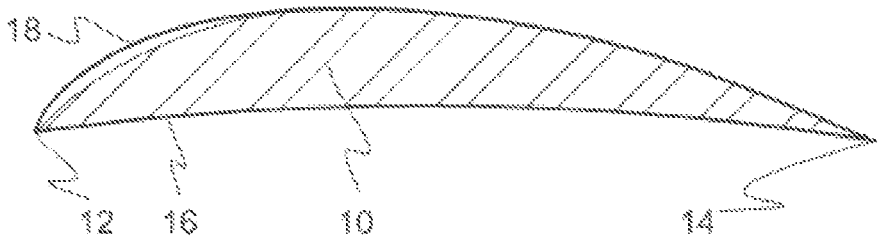
Fig. 1e (D - D)
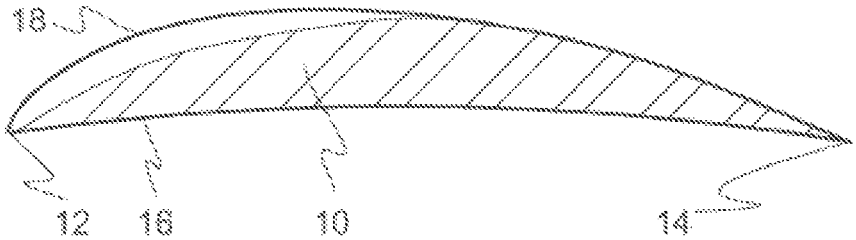
Fig. 1f (E - E)

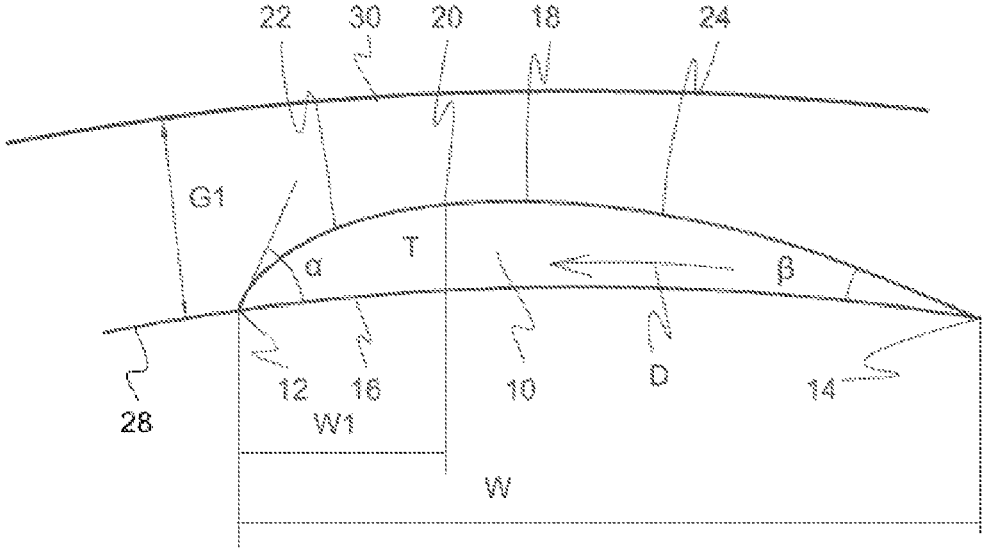
Fig. 3
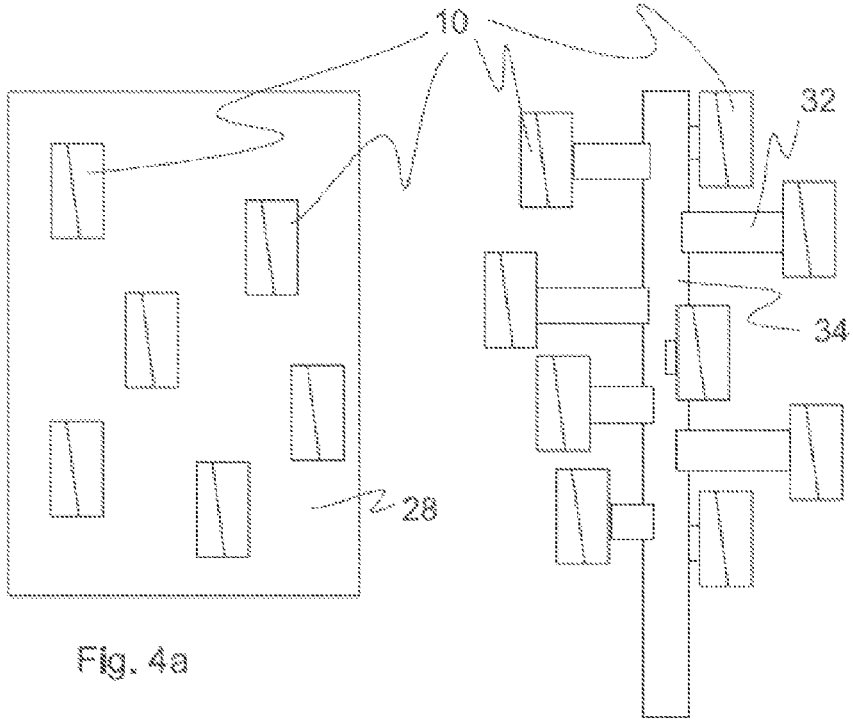
Fig. 4a
Fig. 4b

ROTOR ELEMENT AND A ROTOR FOR A SCREENING APPARATUS

This application is the U.S. national phase of International Application No. PCT/FI2008/050144 filed 28 Mar. 2008 which designated the U.S. and claims priority to Finland Patent Application No. 20070257 filed 30 Mar. 2007, the entire contents of each of which are hereby incorporated by reference.

The present invention relates to a rotor element and a rotor for a screening apparatus. The rotor element and the rotor of present the invention are particularly suitable for use in connection with screening apparatuses of the pulp and paper industry.

The most popular screening apparatus used nowadays in the pulp and paper industry comprises a stationary screen cylinder and a rotating rotor therein. The purpose of the screen cylinder is to divide the fresh pulp or fiber suspension entering into the screening cavity, where the rotor rotates, into an acceptable fiber fraction called the accepts, and a rejectable fiber fraction called the rejects. The screen cylinder as well as, naturally, the rotor are located inside a screen housing having ducts for the fresh fiber suspension, the accepts, and the rejects. Normally, the inlet duct or inlet for the fiber suspension is at one end of the screen housing, whereby the rejects outlet is at the opposite end of the housing. The accepts outlet is in communication with the accepts cavity, which is positioned at the opposite side of the screen cylinder in relation to the screening cavity.

In accordance with the prior art there are, in principle, two different types of rotors, which are commonly used in the pulp and paper industry and the intention of which, as known, is to maintain the screen surface clean, in other words to prevent the formation of a fiber mat on the screen surface, and maintain sufficient turbulence in the cavity containing the fresh, i.e. non-screened, fiber suspension. An example of one rotor type is disclosed in U.S. Pat. No. 4,193,865 in which the rotor is arranged inside a cylindrical, stationary screen cylinder. The rotor comprises a concentric shaft and a number of foils located close to the surface of the screen cylinder. Each foil is supported on the shaft by means of a pair of arms extending through the cavity, which contains fresh pulp when the screening apparatus is in operation. The foils of the above-mentioned patent form an angle with the shaft of the rotor and the axis of the screen cylinder. The moving foils create pressure pulses on the screen surface which, on one hand, push acceptable fibers through the screening openings, and, on the other hand, clear the openings of the screen surface and prevent fibers from accumulating within the openings in the screen surface and blocking the openings.

Other foil-type rotors have been discussed, for instance in U.S. Pat. No. 5,547,083 and EP-B1-0 764 736. A typical feature of the foil of the former document is that the foil is provided with axially extending wings or channels on the surface facing the screen cylinder, with the wings or channels subjecting the fiber suspension to an axially-oriented force component. The EP document teaches, like the already discussed U.S. Pat. No. 4,193,865, that the foil may be positioned so that the longitudinal direction of the foil forms an angle with the axial direction, i.e. the foil is turned or wound into a slightly spiral direction.

An example of the other rotor type has been discussed, for instance, in U.S. Pat. No. 3,437,204, in which the rotor is a substantially cylindrical closed body positioned inside a screen cylinder. The rotor surface is provided with protrusions, which are almost hemispherical in form. In this kind of an apparatus, the fresh fiber suspension is fed between the rotor and the screen cylinder, whereby the protrusions of the rotor, the so-called bumps, create turbulence and pressure pulses towards and away from the screen cylinder. In other words, the leading surface of each bump pushes the pulp towards the screen cylinder and the form of the bump induces a suction pulse that draws the fiber accumulations from the openings in the screen cylinder.

U.S. Pat. No. 5,000,842 discusses a rotor having a cylindrical basic form with protrusions on the rotor surface. The protrusions shown in the US document have a leading surface, which is substantially perpendicular to the cylindrical rotor surface, a sloping trailing surface, and a surface parallel to the cylindrical rotor surface therebetween. The principal object of the rotor structure disclosed in the US document is to control the fiber suspension flow in the screening cavity between the screen cylinder and the rotor. The protrusions on the rotor have been designed to not only create radial pressure pulses to the fiber suspension, but also to subject the fiber suspension to axial forces, the direction of which is dependent on the axial position of the protrusion on the rotor surface. It was believed in the US document that immediately after entering the screening apparatus, the fiber suspension needs to be pumped axially towards the rejects end of the rotor. For this reason, the protrusions have a leading surface, which in addition to being substantially perpendicular to the rotor surface, is also inclined such that it forms an acute angle with the axial direction. At the inlet end of the rotor, the inclination has been arranged such that the leading surface of the protrusion subjects the fiber suspension to a force component that moves the fiber suspension towards the rejects end of the rotor.

The protrusions at the axial center region of the rotor are substantially neutral i.e. they do not subject the fiber suspension to any significant axial force components. The reason is that at the center region of the rotor, the fiber suspension contains a sufficient amount of rejectable material that it requires more time to separate good and acceptable fibers from the rejects, whereby the axial speed of the fiber suspension need not be increased. The closer to the rejects end on the rotor surface a protrusion is located, the more inclined is the leading surface of the protrusion in a direction that subjects the fiber suspension to a force component directed towards the inlet end of the rotor. Thus the purpose of the protrusions at the rejects end of the rotor is to decelerate the axial pulp flow and to give the high-reject concentration suspension more time in the screening cavity so that the acceptable fibers would have time to separate and be accepted by the screen cylinder.

U.S. Pat. No. 5,000,842 also teaches a protrusion structure where the protrusion extends continuously from the first end of the rotor to the second end thereof. When such a configuration is used, the protrusion may either be curved to result in the same effect as explained above, or the leading edge of the protrusion may be designed to create an axial force component the magnitude of which changes along the length of the protrusion. However the leading surface of the protrusion is always perpendicular to the cylindrical rotor surface, which results in a situation that is not necessarily good. First, since the leading surfaces of the protrusions are perpendicular to the rotor surface, the rotor tends to make the fiber suspension rotate at a high circumferential speed. Since, in view of screening there is a certain optimal speed range the fibers should flow in relation to the screen surface, the axial length of the protrusions have been shortened in the practical applications of the rotor of U.S. Pat. No. 5,000,842. This causes great changes in the turbulence level in the screening space, which has some negative effects. For instance, the strong pressure pulses set high demands for the strength of the screen cylinder because the pressure pulses tend to impose cyclical forces on the screen cylinder that can lead to fatigue failure. This is especially true when the protrusion extends from one end of the rotor to the other whereby the screen cylinder is subjected to a substantially axial linear pressure pulse. Second, due to the shape of the leading surface of the protrusions, the energy needed for rotating the rotor is high. Third, such aggressively-designed protrusions, together with the high turbulence they create, may cause fiber damage during the screening action. Fourth, the aggressive protrusions will cause the fiber suspension to rotate in such a high circumferential speed that the capacity of the screening apparatus may decrease.

Other patent documents that discuss rotors having protrusions with either exactly or substantially perpendicular leading surfaces are DE-A1-39 11 234 and DE-A1-37 01 669.

There are also rotor types where the protrusions on the substantially cylindrical rotor surface do not have a leading surface perpendicular to the rotor surface. One such rotor structure has been discussed in DE-A1-28 49 769, where the rotor is provided with wedge-shaped protrusions. The protrusion of the DE document is formed from an inclined leading surface and a trailing surface perpendicular to the cylindrical rotor surface. The operation of this kind of a protrusion is somewhat gentler than the one of the previous option discussed above. In other words, the leading surface of the rotor does not tend to rotate the pulp as much in the circumferential direction, but pushes the pulp towards the screen surface. However, since the trailing surface of the protrusion is perpendicular to the rotor surface, both the turbulence created by the protrusion and the low pressure zone created behind the protrusion are very powerful, which requires substantially high power to rotate the rotor.

DE-A1-27 12 715 discusses a rotor structure where the protrusions of their shape are somewhere in between the protrusions discussed above. Here the protrusions have leading and trailing surfaces perpendicular to the cylindrical rotor surface. The two mentioned perpendicular surfaces are joined by means of an inclined surface and a surface parallel to the cylindrical rotor surface. Due to the perpendicular surfaces of the rotor, the turbulence created by the rotor is high, which means high energy consumption, a high rotational speed of the fiber suspension, possible fiber damage, lowered capacity of the screening apparatus etc.

DE-A1-40 28 772 discusses yet another rotor having a basically cylindrical cross-section. The rotor is either provided with protrusions having a bulb shape i.e. the shape of a calotte like in U.S. Pat. No. 3,437,204, or a protrusion extending in an axial direction from one end of the rotor to the other end thereof. The lengthy protrusion has two options: The protrusion is formed either from a continuous surface having a constant radius (smaller than the rotor cylinder radius) or it is formed from several curved surfaces. The drawings of the documents show a protrusion being formed of two curved surfaces with the edge between the surfaces being positioned in the axial direction of the rotor. The protrusions are fastened on the rotor surface by means of a hole through the rotor surface in which hole the root-part of the protrusion is shrink-fitted. Another option for fastening is the use of an appropriate adhesive. The protrusions may be manufactured of a light plastic material, for instance, of polyamide. It appears that the essential feature of the rotor protrusion is that it is axially oriented, whereby it is not able to effect any axial pushing of the fiber suspension. Additionally it appears that the protrusions shown in the Figs. of the document are symmetrical to the centreline thereof.

An object of the invention is to develop a rotor element or protrusion and a rotor, which avoid at least some of the drawbacks discussed in connection with the above prior art rotors.

Other objects of the present invention are: to design a rotor or a rotor element that is energy efficient, that does not damage the fibers, and that is able to provide the fiber suspension in the screening cavity with axially-oriented turbulence, i.e. to feed the fiber suspension axially towards the reject end of the rotor. Further, the pressure pulses created by the rotor are so mild and/or arranged such that the pulses are not able to impose harmful cyclical forces on the screen cylinder. A further object of the invention is to design a rotor, which is able to increase the capacity of the screening apparatus by optimising the cooperation between the rotor and the screen cylinder.

The above-mentioned objects are achieved by means of a novel rotor element and rotor construction, the characterizing features of which will become clear in the appended claims.

Figure 2A:
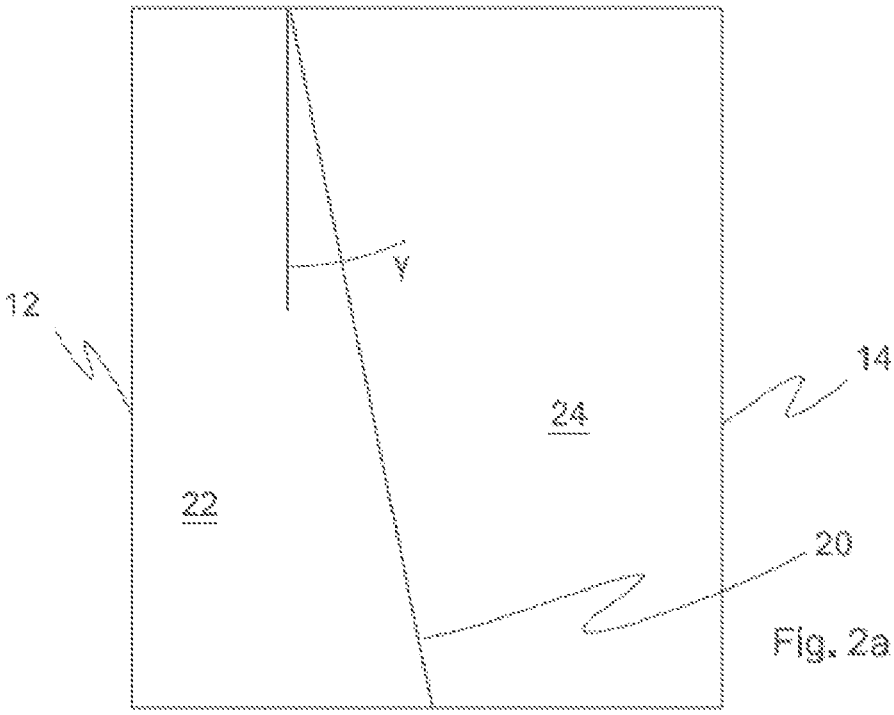
Figure 2B:
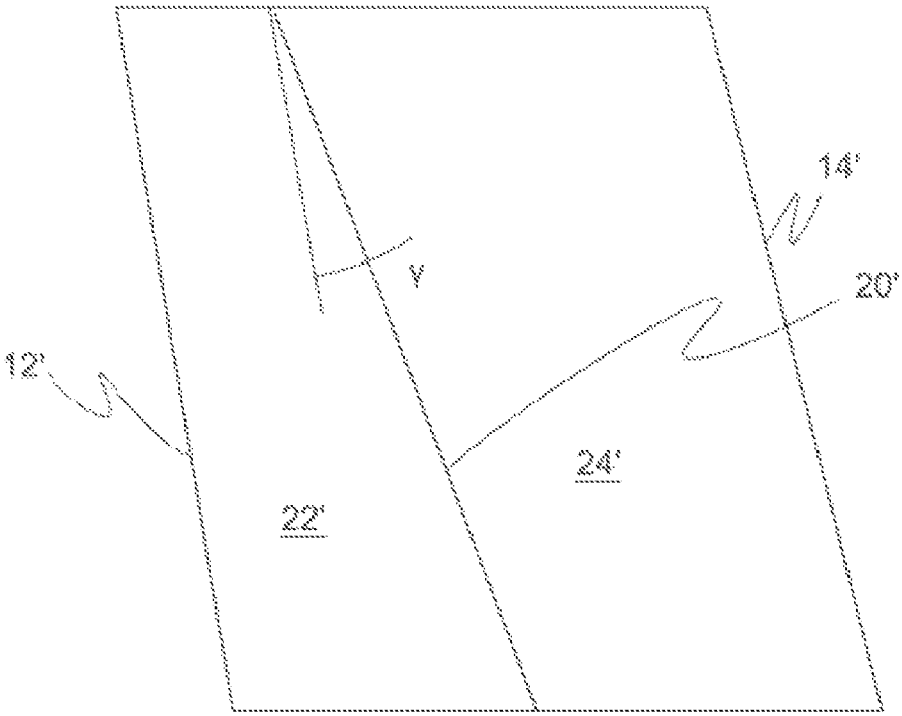

The rotor element and the rotor of the present invention is discussed in more detail in the following text with reference to the accompanying drawings of which:

FIG. 1*a* illustrates a top view of a rotor element in accordance with a preferred embodiment of the present invention, FIGS. 1*b*-1*f* illustrate five different cross-sections along the length of a rotor element in accordance with a preferred embodiment of the present invention, FIG. 2*a* illustrates the rotor element of FIGS. 1*a*-1*f* seen from above, FIG. 2*b* illustrates another preferred embodiment of the rotor element of the present invention, FIG. 3 illustrates schematically a rotor element/rotor and screen cylinder combination in accordance with a preferred embodiment of the present invention, and FIGS. 4*a* and 4*b* illustrate schematically two basic types of rotors utilizing the rotor elements in accordance with the invention.

In FIG. 1*a* a rotor element 10 of a preferred embodiment of the present invention is shown as a top view i.e. seen from outside the rotor in radial direction towards the rotor axis. The rotor element 10 is purposed to be attached on a substantially rotationally-symmetrical, advantageously cylindrical surface of a rotor body or by means of at least one arm to the shaft of a so-called foil rotor. The axial length (normally vertical direction) of the rotor element is of the order of 100 to 300 mm. In a corresponding manner the circumferential width of the rotor element is of the order of 75 to 250 mm and the maximum thickness of the element is in the range of 10 to 30 mm. The aspect ratio of this element is defined as the axial length divided by the circumferential width. In general, the aspect ratio is in the range of 1.0 to 2.0. The rotor element 10 is provided, in this embodiment of the invention (shown also in FIG. 2*a*), with two longitudinal parallel edges, a leading edge 12 and a trailing edge 14, and two opposite ends. When the rotor element is purposed to be used in connection with a substantially cylindrical rotor both the leading edge 12 and the trailing edge 14 are in contact with the rotor surface i.e. the rotor body.

FIGS. 1*b*-1*f* show five cross-sections taken along the length of the rotor element 10. FIG. 1*b* shows the cross-section of the rotor element 10 at the first end of the rotor element closer to the fiber suspension inlet, i.e. most often the upper or top end of the rotor. FIG. 1*c* shows the cross section of the rotor element 10 at a distance of about 20-30% of the rotor element length from the first end of the element. FIG. 1*d* shows the rotor element cross-section at about the center of the length of the rotor element. FIG. 1*e* shows the rotor element cross-section at a distance of about 70-80% from the first end of the rotor element and FIG. 1*f* shows the cross-section at the second end of the rotor element. FIGS. 1*b* and 1*c* show that in this embodiment, at the first end of the rotor element (i.e. the two uppermost sections) the shape of the cross-section of the element is wing-like. That is, the lower surface 16 of the element 10 has, naturally, the curvature of the rotor body, whereas the upper surface 18 has a curvature (steadily) increasing from the leading edge 12 of the element 10 towards the trailing edge 14 of the element 10.

When coming further downwards, towards the second or bottom end of the element, the cross-section taken at the center of the element (FIG. 1*d*) has changed when compared to the earlier discussed cross-sections. The hatching in FIG. 1*d* shows that the rotor element body portion close to the leading edge 12 of the element 10 is lower than in the earlier FIGS. 1*b* and 1*c*. The trailing part of the element cross-section has remained the same.

When coming an additional one-fourth of the element length downwards, FIG. 1*e* shows that the leading part of the element 10 has got still lower. FIG. 1*f* shows the bottom of the element where the leading part of the element is at its lowest. FIG. 1*f* shows that the cross-section of the element is, in this embodiment of the invention, substantially symmetrical to its centreline.

A way to describe the shape of the rotor element of the invention is to define the position of the peak point at the upper surface 18 of the element 10 where the rotor element 10 is at its thickest. In accordance with a preferred embodiment of the invention, the above-defined peak points form a borderline along the length of the element. At the first or upper end of the element 10, the peak point is substantially close to the leading edge of the element, only some 15-30% of the element width from the leading edge. At the second or lower end of the element, the peak point is some 40-60% of the element width from the leading edge. In accordance with other preferred embodiments, a curve or line connects the above defined peak points, however, the mutual positions of the peak points at the first and second end of the rotor element remain substantially the same.

By means of the shape of the rotor element, the objects of the invention are achieved. The somewhat steeper upper surface at the first end of the element creates more turbulence than the less-inclined top surface farther away of the first end. However, as the first end of the element has to subject the pulp to a certain amount of energy to create the turbulence sufficient for successful screening operation, it is clear that less energy is needed to maintain the turbulence. Therefore the shape of the rotor element may be more streamlined farther away from the first end thereof.

Additionally, when looking at the rotor element from above (FIGS. 2*a* and 2*b*), it can be seen that the line or curve joining the peak points of the thickest part of the element is inclined (angle γ) in such a direction that the rotor element, when rotating, subjects the fiber suspension in the screening cavity to an axially-downwardly directed force component. FIGS. 2*a* and 2*b* also shows how the upper surface 18 (of FIGS. 1*b*-1*f*) of the rotor element is divided by means of the borderline 20, 20' into two surfaces, a leading surface 22, 22' initiating from the leading edge 12, 12', and a trailing surface 24, 24' initiating from the trailing edge 14, 14'.

While FIG. 2*a* shows the rotor element of FIG. 1*a* somewhat more in detail, FIG. 2*b* illustrates a rotor element in accordance with another preferred embodiment of the invention. In the rotor element of FIG. 2*b* the leading and trailing edges 12' and 14' are not even substantially axial but form a certain angle with the axial direction. Now already the overall shape of the rotor element subjects the pulp to be screened to an axial force component. However, such a force component is strengthened by means of arranging the borderline 20' in the same inclination (angle γ; in accordance with a preferred embodiment of the invention the angle γ was of the order of 30 degrees) with the longitudinal direction of the rotor element as in the embodiment of FIG. 2*a*. However, it is not necessary to use the same inclination angle in this structure but the angle may be either increased or decreased when compared to the angle of FIG. 2*a*. Also, in addition to keeping the leading and trailing edges, 12' and 14' respectively, parallel, it is possible to arrange such in different directions whereby the circumferential width of the rotor element may change along the axial length of the element. Thus the element may be wider or narrower at its upper end. Further, it has to be understood that the longitudinal edges and the ends of the rotor elements may also be curved unlike shown in the Figures. Yet one thing worth mentioning are the end surfaces of the rotor element. The surfaces are preferably arranged at right angles to the axial direction of the rotor or to the rotor surface, but they may as well be arranged at an angle to the rotor surface or to the axial direction. In other words, the end surfaces may, for instance, slope towards the rotor surface at an angle of 60-30 degrees.

Performed tests have shown that though the shape of the rotor element of the invention is not even nearly as violent as the prior art elements, the performance, overall efficiency, and accepted pulp quality, especially in view of energy consumption, when using the rotor element of the invention are at least comparable, and in most cases far better compared to the rotors of the prior art. For instance, one thing that has been learned is that in a certain application the rotational speed of the rotor of the invention needed to result in a certain capacity (both in view of the amount of accepts, and the cleanliness of the accepts) was lower than that of the rotors of prior art, whereby the energy consumption was lowered.

FIG. 3 shows a schematical end view of the protrusion or rotor element 10 of the invention attached on the surface 28 of a substantially cylindrical rotor body. The rotational direction of the rotor has been shown by arrow D. FIG. 3 shows also the screen cylinder 30 arranged at a distance G1 from the rotor surface 28. The protrusion or rotor element 10 has a length W, and a thickness T. The element 10 is at its thickest (thickness T) at a distance of W1 from the leading edge 12 of the rotor element 10. The upper surface 18 (the surface facing the screen cylinder 30) of the rotor element 10 is divided by means of a borderline 20 in the leading surface 22 and the trailing surface 24. The borderline 20 runs along the surface 18 of the rotor element via the peak points where the rotor element 10 is the thickest. The angle α between the leading surface 22 of the element 10 and the rotor surface is an acute angle. In a similar manner, at the trailing edge 14 of the rotor element 10, an acute angle β is formed between the rotor element trailing surface 24 and the rotor surface 28.

The distance from the element surface (from borderline 20) to the surface of the screen cylinder is preferably in the range of 4 mm to 10 mm. As to the angles α and β discussed above the angle α of contact with the rotor surface 28 at the leading edge 12 of the element is in the range of 45 to 90 degrees at the top cross-section (shown in FIG. 1*b*). The angle β of contact with the rotor surface 28 at the trailing edge 14 is in the range of 5 to 30 degrees at the top cross-section (FIG. 1*b*). The angles α and β of contact with the rotor surface 28 at the leading and trailing edges 12, 14 are in the range of 5 to 30 degrees at the bottom cross-section (shown in FIG. 1*f*).

As to, on the one hand, the thickness of the rotor element 10, and, on the other hand, the direction or type of the borderline 20, 20', it has to be noted that the element thickness may change along the length of the element. The change in the thickness may be linear, but it may as well be non-linear. It is, thus, possible that the thickness increases or decreases from the first end of the element towards the second end thereof, but it is as well possible that the thickness is greater at the ends of the element than at the center region, or that the element is at its highest at the center region. Since the borderline 20, 20' between the element surfaces represents the highest or peak part of the element, it should also be noted that the borderline may be either linear or curved along the length of the element so that the functional properties of the element may be adjusted by the construction of the element. It is, for instance, possible that the borderline runs close to the first end of the element parallel with the leading edge of the element, and turns to inclined direction closer to the second end of the element. The borderline may also be inclined, in relation to the leading edge of the element, at both ends of the element, but be parallel at the center region of the element. Also, the borderline may be inclined at the first end of the element, but turn to parallel with the leading edge closer to the second end of the element. And finally, it has to be understood that by the term 'inclined' also non-linear configurations are covered as well as inclinations into both directions from the parallel direction.

FIG. 4*a* shows an exemplary embodiment where the rotor elements 10 of the invention are positioned on the surface of a substantially (including all rotationally symmetric rotor types) cylindrical rotor surface 28. The elements 10 may be positioned either more or less randomly, or, more preferably, in accordance with a certain well-designed pattern on the surface 28 of the rotor to provide regular and periodic pulsations at the aforementioned openings in the screen cylinder.

FIG. 4*b* shows as another exemplary embodiment, the rotor elements 10 arranged by means of arms 32 on the rotor shaft 34, including also structures where the rotor is formed of a cylindrical or otherwise rotationally symmetrical body on which the rotor elements are arranged by means of arms. As above in FIG. 4*a* the elements may be arranged more or less randomly on the rotor shaft, and more preferably in a certain well-designed pattern to provide regular and periodic pulsations at the aforementioned openings in the screen cylinder.

While the invention has been discussed and described above in view of a few preferred embodiments, it has to be understood that the above description should by no means be considered as limiting the scope of the invention from what has been disclosed in the appended claims. Also it has to be understood that various specific details discussed in connection with a certain embodiment may be used in connection with other embodiments of the invention whenever practically possible.

The invention claimed is:

1. A rotor element for use with a rotor of a screening apparatus of the pulp and paper industry, said rotor element comprising: two longitudinal edges, a leading edge and a trailing edge, wherein the leading edge forms an acute angle $\alpha$ with a surface of the rotor or a lower surface of said rotor element and wherein the trailing edge forms an acute angle $\beta$ with the surface of the rotor or the lower surface of said rotor element; two opposite axial ends, a first axial end and a second axial end; a surface arranged between said leading edge and said trailing edge, said surface divided by a borderline into a leading surface extending from said leading edge to said borderline and a trailing surface extending from said trailing edge to said borderline; and a distance (W1) between said borderline and said leading edge; wherein said distance (W1) varies between the first axial end and the second axial end of the rotor element.

2. The rotor element of claim 1, wherein said distance (W1) is smaller at said first axial end of said rotor element than at said second axial end of said rotor element.

3. The rotor element of claim 1, wherein said rotor element comprises a thickness, and wherein said thickness is greatest at said borderline.

4. The rotor element of claim 1, wherein said element is adapted to be attached to the surface of the rotor.

5. The rotor element of claim 1, wherein said element is adapted to be attached to an arm on the surface of the rotor.

6. The rotor element of claim 1, wherein said element is adapted to be attached to an arm on a shaft of the rotor.

7. The rotor element of claim 1, wherein said angle $\alpha$ is between 45 and 90 degrees.

8. The rotor element of claim 1, wherein said angle $\beta$ is between 5 and 30 degrees.

9. The rotor element of claim 1, wherein said angle $\alpha$ decreases along an axial length of the rotor element.

10. The rotor element of claim 1, wherein said angle $\alpha$ is between 5 and 30 degrees at said second axial end of the rotor element.

11. The rotor element of claim 1, wherein said leading edge and said trailing edge are parallel to a rotor axis.

12. The rotor element of claim 1, wherein said leading edge and said trailing edge each form an angle to an axial direction.

13. The rotor element of claim 1, wherein said element has a length in an axial direction of the rotor between 100 and 300 mm.

14. The rotor element of claim 1, wherein said element has an aspect ratio between 1.0 and 2.0.

15. The rotor element of claim 1, wherein said element has a maximum thickness in a radial direction of the rotor between 10 and 30 mm.

16. The rotor element of claim 3, wherein the maximum thickness of said element varies along a length of the element.

17. A rotor for use in a screening apparatus of the pulp and paper industry, said rotor comprising turbulence creating rotor elements, each of said rotor elements comprising: two longitudinal edges, a leading edge and a trailing edge, wherein the leading edge forms an acute an angle $\alpha$ with a surface of the rotor or a lower surface of the rotor element and wherein the trailing edge forms an acute angle $\beta$ with the surface of the rotor or the lower surface of the rotor element; two opposite axial ends, a first axial end and a axial second end; a surface arranged between said leading edge and said trailing edge, said surface divided by a borderline into a leading surface extending from said leading edge to said borderline, and a trailing surface extending from said trailing edge to said borderline; and a distance (W1) between said borderline and said leading edge; wherein said distance (W1) varies between said first axial end and said second axial end of said rotor element.

18. The rotor of claim 17, wherein said distance (W1) is smaller at said first axial end of said rotor element than at the second axial end of said rotor element.

19. The rotor of claim 17, wherein said elements are attached on a surface of the rotor.

20. The rotor of claim 17, wherein each of said elements is attached by an arm to a surface of the rotor.

21. The rotor of claim 17, wherein each of said elements is attached by an arm on a shaft of the rotor.

22. The rotor of claim 17, wherein said angle $\alpha$ is between 45 and 90 degrees at said first axial end of the rotor element.

23. The rotor of claim 17, wherein said angle $\beta$ is between 5 and 30 degrees.

24. The rotor of claim 17, wherein said angle $\alpha$ decreases along an axial length of the rotor element.

25. The rotor of claim 17, wherein said angle $\alpha$ is between 5 and 30 degrees at said second axial end of the rotor element.

26. The rotor of claim 17, wherein said leading edge and said trailing edge are parallel to a rotor axis.

27. The rotor of claim 17, wherein said leading edge and said trailing edge each form an angle to an axial direction.

28. The rotor of claim 17, wherein said element has a length in an axial direction of the rotor between 100 and 300 mm.

29. The rotor of claim 17, wherein said element has an aspect ratio between 1.0 and 2.0.

30. The rotor of claim 17, wherein said element has a maximum thickness in a radial direction of the rotor between 10 and 30 mm.

31. The rotor of claim 30, wherein the maximum thickness of said element varies along a length of the element.

32. The rotor element of claim 1, wherein the leading edge forms the acute angle $\alpha$ with the surface of the rotor and wherein the trailing edge forms the acute angle $\beta$ with the surface of the rotor.

33. The rotor element of claim 1, wherein the leading edge forms the acute angle $\alpha$ with the lower surface of the rotor element and wherein the trailing edge forms the acute angle $\beta$ with the lower surface of the rotor element.

34. The rotor of claim 17, wherein the leading edge forms the acute angle $\alpha$ with the surface of the rotor and wherein the trailing edge forms the acute angle $\beta$ with the surface of the rotor.

35. The rotor of claim 17, wherein the leading edge forms the acute angle $\alpha$ with the lower surface of the rotor element and wherein the trailing edge forms the acute angle $\beta$ with the lower surface of the rotor element.

* * * * *